US009291996B2

(12) United States Patent
Nakano et al.

(10) Patent No.: US 9,291,996 B2
(45) Date of Patent: Mar. 22, 2016

(54) IMAGE FORMING APPARATUS

(71) Applicant: Konica Minolta, Inc., Chiyoda-ku (JP)

(72) Inventors: Motoki Nakano, Toyokawa (JP); Masashi Saito, Hachioji (JP); Yutaka Otsuka, Toyokawa (JP); Hideaki Hayashi, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/278,753

(22) Filed: May 15, 2014

(65) Prior Publication Data

US 2014/0341607 A1 Nov. 20, 2014

(30) Foreign Application Priority Data

May 15, 2013 (JP) ..... 2013-102815

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
USPC ..... 399/92
See application file for complete search history.

(56) References Cited

U.S. PATENT DOCUMENTS 5,023,654 A * 6/1991 Matsumoto et al. ..... 355/405
2004/0037582 A1* 2/2004 Shin ..... 399/93
2011/0211859 A1* 9/2011 Shimoyama et al. ..... 399/93
2011/0255895 A1* 10/2011 Kim et al. ..... 399/92
2012/0141173 A1* 6/2012 Iwasaki ..... 399/327
2012/0315061 A1* 12/2012 Kondo et al. ..... 399/92

FOREIGN PATENT DOCUMENTS

JP 2010-002803 A 1/2010
JP 2011095569 5/2011
JP 2011-141447 A 7/2011
JP 2011-145576 7/2011
JP 2012-047790 A 3/2012

OTHER PUBLICATIONS

Notification of Reasons for Refusal issued in corresponding Japanese Patent Application No. 2013-102815, mailed Jun. 2, 2015, with English translation (8 pages).
Notification of Reasons for Refusal issued in corresponding Japanese Patent Application No. 2013-102815, mailed Aug. 18, 2015, with English translation (7 pages).

* cited by examiner

*Primary Examiner* — Benjamin Schmitt
(74) *Attorney, Agent, or Firm* — Buchanan Ingersoll & Rooney PC

(57) ABSTRACT

An image forming apparatus has a fusing unit including a first rotor provided with a heat-generating unit and an elastic layer, as well as a second rotor provided in direct contact with the first rotor, the fusing unit fixing a toner image on a sheet, and a duct for allowing an inlet and an exhaust outlet to communicate with each other, the inlet being adapted to allow a current of air derived from the fusing unit to flow in, the exhaust outlet facing toward the outside of the apparatus. The duct includes an introduction channel for guiding and jetting out air taken in from the inlet, a main channel for guiding the air jetted out of the introduction channel to the exhaust outlet, and a cul-de-sac provided in communication with the main channel at one end and closed at the other end.

7 Claims, 6 Drawing Sheets

IMAGE FORMING APPARATUS

This application is based on Japanese Patent Application No. 2013-102815 filed on May 15, 2013, the content of which is incorporated herein by reference.

BACKGROUND OF THE INVENTION

1. Field of the Invention

The present invention relates to an image forming apparatus including a duct that traps ultrafine particles (UFPs) contained in the air surrounding a fusing unit while discharging the air to the outside of the apparatus.

2. Description of Related Art

Some conventional image forming apparatuses of this type include devices for removing ultrafine particles, as described in, for example, Japanese Patent Laid-Open Publication No. 2012-47790. Such an ultrafine particle removal device includes a duct and a suction fan for removing ultrafine particles, which are mainly derived from silicone rubber used as an elastic member of a fusing device. The duct has first and second terminus portions in which first and second openings are formed so as to face opposite ends, respectively, of a fusing roller in an axial direction. Moreover, the first terminus portion has a first suction port provided in the surface that is opposed to the first opening. Similarly, the second terminus portion is provided with a second suction port.

However, it is expected that the image forming apparatus will be required to further suppress the amount of UFP emission in the future.

SUMMARY OF THE INVENTION

An image forming apparatus according to a first aspect of the present invention includes an image forming unit for feeding a sheet after forming a toner image on the sheet, a fusing unit including a first rotor provided with a heat-generating unit and an elastic layer, as well as a second rotor provided in direct contact with the first rotor to create a nip, the fusing unit fixing a toner image on a sheet fed by the image forming unit and introduced into the nip, a duct for allowing an inlet and an exhaust outlet to communicate with each other, the inlet being adapted to allow a current of air derived from the fusing unit to flow in, the exhaust outlet facing toward the outside of the apparatus, and a blowing unit for causing a current of air toward the exhaust outlet within the duct. The duct includes an introduction channel for guiding and jetting out air taken in from the inlet, a main channel for guiding the air jetted out of the introduction channel to the exhaust outlet, and a cul-de-sac provided in communication with the main channel at one end and closed at the other end.

DETAILED DESCRIPTION OF THE PREFERRED EMBODIMENTS

Embodiment

Figure 1:
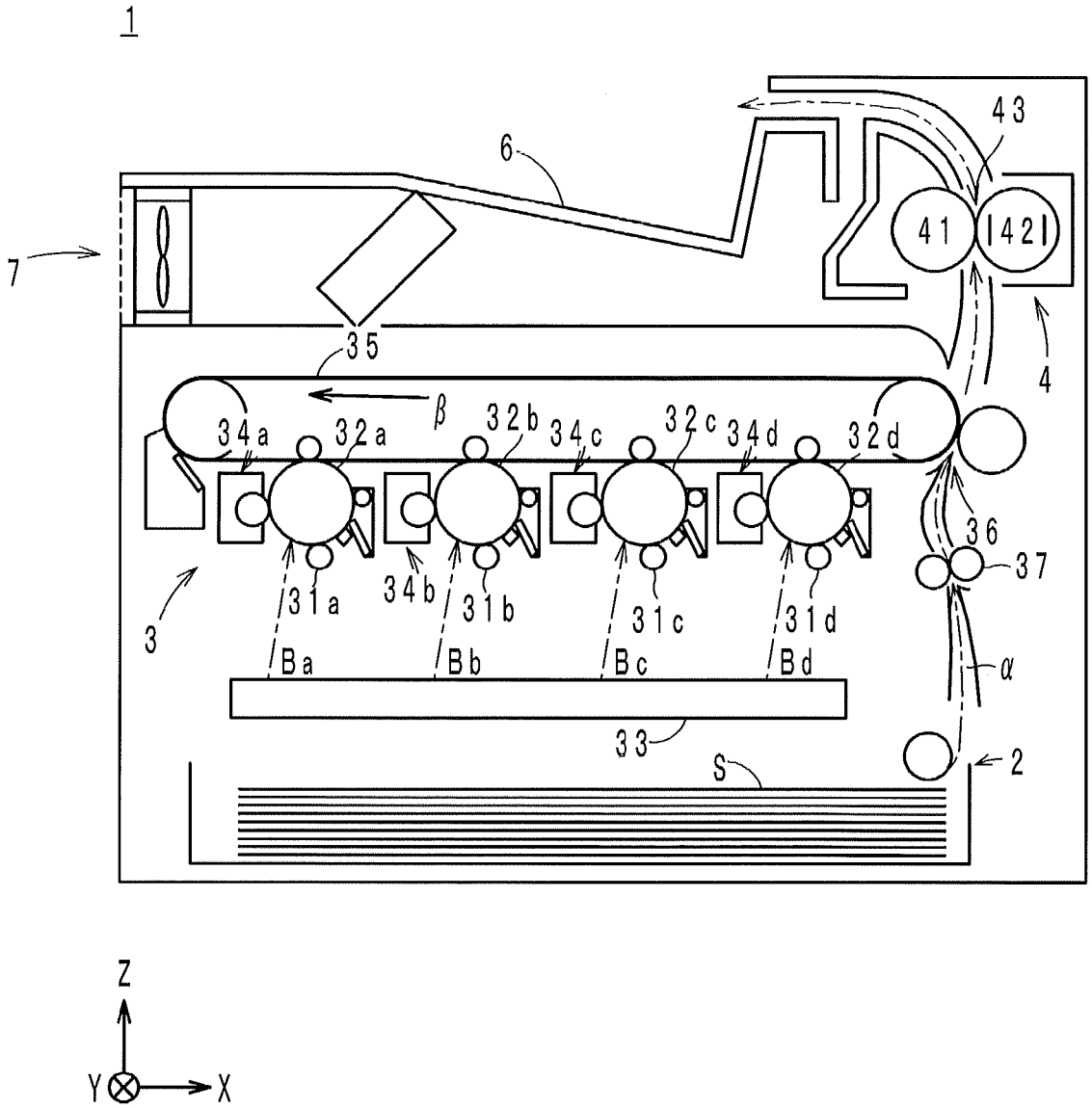
FIG. 1 is a schematic diagram illustrating the general configuration of an image forming apparatus.

Hereinafter, an image forming apparatus according to an embodiment will be described in detail with reference to the drawings.

Preliminary Notes

First, the X-, Y-, and Z-axes in the drawings will be described. The X-, Y-, and Z-axes are perpendicular to one another. In addition, the X-, Y-, and Z-axes represent the right-left, front-back, and top-bottom directions, respectively, of the image forming apparatus 1. Moreover, the direction of the Y-axis is the direction in which the image forming apparatus 1 is viewed from the front. Further, the opposite direction to the Z-axis is the direction in which the image forming apparatus 1 is viewed from the top.

Furthermore, the lowercase alphabet letters a, b, c, and d added to the ends of reference numerals are suffixes representing yellow (Y), magenta (M), cyan (C), and black (Bk), respectively. For example, a photoreceptor drum 32*a* is intended to mean a photoreceptor drum for yellow.

Configuration and Operation of Image Forming Apparatus

In FIG. 1, the image forming apparatus 1 is, for example, an electrophotographic multifunction peripheral (MFP), copier, printer, or facsimile. Moreover, the image forming apparatus 1 employs, for example, a tandem configuration to print full-color images onto sheets (e.g., paper or OHP films). The image forming apparatus thus configured generally includes a feeding device 2, an image forming unit 3, and a fusing unit 4.

The feeding device 2 has a plurality of sheets S mounted as a sheet stack. The feeding device 2 picks up the sheets S one by one from the sheet stack, and feeds them into a transportation path indicated by arrow α of a long dashed short dashed line (referred to below as a transportation path α).

In the image forming unit 3, charging units 31*a* to 31*d* uniformly charge the circumferential surfaces of photoreceptor drums 32*a* to 32*d*, which are rotating. The charged surfaces of the photoreceptor drums 32*a* to 32*d* are irradiated with optical beams Ba to Bd from an exposing device 33, so that electrostatic latent images in Y, M, C, and Bk are formed. Developing units 34*a* to 34*d* supply toner to the photoreceptor drums 32*a* to 32*d* supporting the respective electrostatic latent images in their corresponding colors, so that toner images in Y, M, C, and Bk are formed. The toner images on the photoreceptor drums 32*a* to 32*d* are sequentially transferred to the same area on an intermediate transfer belt 35, which is rotating in the direction of arrow β (primary transfer). As a result, a full-color composite toner image is formed on the intermediate transfer belt 35. The composite toner image is carried on the intermediate transfer belt 35 toward a secondary transfer area 36.

Furthermore, a sheet S fed from the feeding device 2 is transported through the transportation path α until it hits a timing roller pair 37, which is at rest without rotating. Thereafter, the timing roller pair 37 starts rotating so as to be synchronized with the timing of transfer in the secondary transfer area 36, thereby feeding the sheet S at a temporary stop toward the secondary transfer area 36.

In the secondary transfer area 36, the composite toner image on the intermediate transfer belt 35 is transferred to the sheet S fed from the timing roller pair 37 (secondary transfer). The sheet S subjected to secondary transfer is fed downstream in the transportation path α as an unfinished sheet S, which is to be subjected to a fixing process.

The fusing unit 4 is of, for example, a heat roller fixing type, and includes a first rotor 41 and a second rotor 42. The rotors 41 and 42 are in direct contact with each other to create a fixing nip 43. The unfinished sheet S is introduced into the fixing nip 43. The fusing unit 4 heats the unfinished sheet S passing through the nip 43, by the rotor 41 while pressing the sheet S by the rotor 42. As a result, the composite toner image on the unfinished sheet S is fixed completely. The sheet S subjected to the fixing process is fed from the nip 43, further downstream in the transportation path α, to be ejected into a tray 6.

Configuration Details of Fusing Unit

Figure 2:
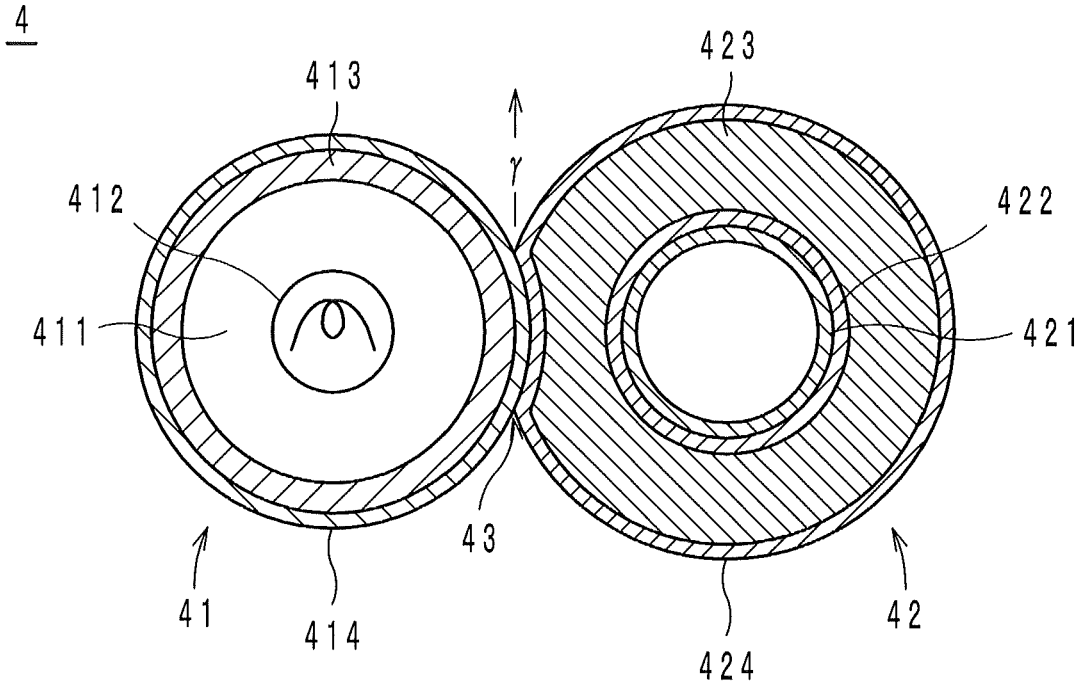
FIG. 2 is a cross-sectional view illustrating in detail the configurations of first and second rotors included in a fusing unit shown in FIG. 1.

The first rotor 41 is a roller having a diameter of 24.8 millimeters [mm] and including an iron core 411, a heater lamp 412, a silicone rubber layer 413, and a heat-resistant release layer 414, as illustrated in FIG. 2.

The heater lamp 412 is an example of a heat-generating unit, and is inserted into the core 411, which is in the form of a cylinder. The silicone rubber layer 413 coats the circumferential surface of the core 411 to a thickness of 0.6 mm. The heat-resistant release layer 414 is perfluoroalkoxy alkane (PFA) tubing (fluororesin tubing) which coats the surface of the silicone rubber layer 413 to a thickness of 40 micrometers [μm]. The heat-resistant release layer 414 is provided in order to prevent toner adhesion. Here, the silicone rubber layer 413 is exposed from opposite ends of the first rotor 41 for convenience of processing.

The second rotor 42 is a roller having a diameter of 30.0 mm and including a STKM steel pipe 421 (where "STKM" indicates that the pipe is in conformity with the tubing specifications for machine structural purposes according to the Japanese Industrial Standard), a silicone rubber layer 422, a silicone sponge layer 423, and a heat-resistant release layer 424.

The silicone rubber layer 422 coats the circumferential surface of the steel pipe 421. The silicone sponge layer 423 coats the surface of the silicone rubber layer 422. These two layers 422 and 423 are used as heat-resistant elastic layers. The heat-resistant release layer 424 is PFA tubing, which coats the surface of the silicone sponge layer 423. Here, the silicone rubber layer 422 and the silicone sponge layer 423 are exposed from opposite ends of the second rotor 42.

The rotor 42 is brought into direct contact with the rotor 41 under a pressure of about 215 newtons [N], thereby creating the fixing nip 43 measuring about 7 mm in the direction in which the sheet S passes therethrough (indicated by arrow γ).

In the fusing unit 4 thus configured, the silicone rubber layer 413 included in the first rotor 41 is heated by the heater lamp 412. As a result of the heating, low-molecular siloxane is diffused from the silicone rubber layer 413 into the air in the form of UFPs. Similarly, UFPs might be diffused into the air also from the two layers 422 and 423 included in the second rotor 42. In addition, UFPs might be also derived from the toner on the sheet S being heated by the fusing unit 4

Configuration of Exhaust System

Figure 3:
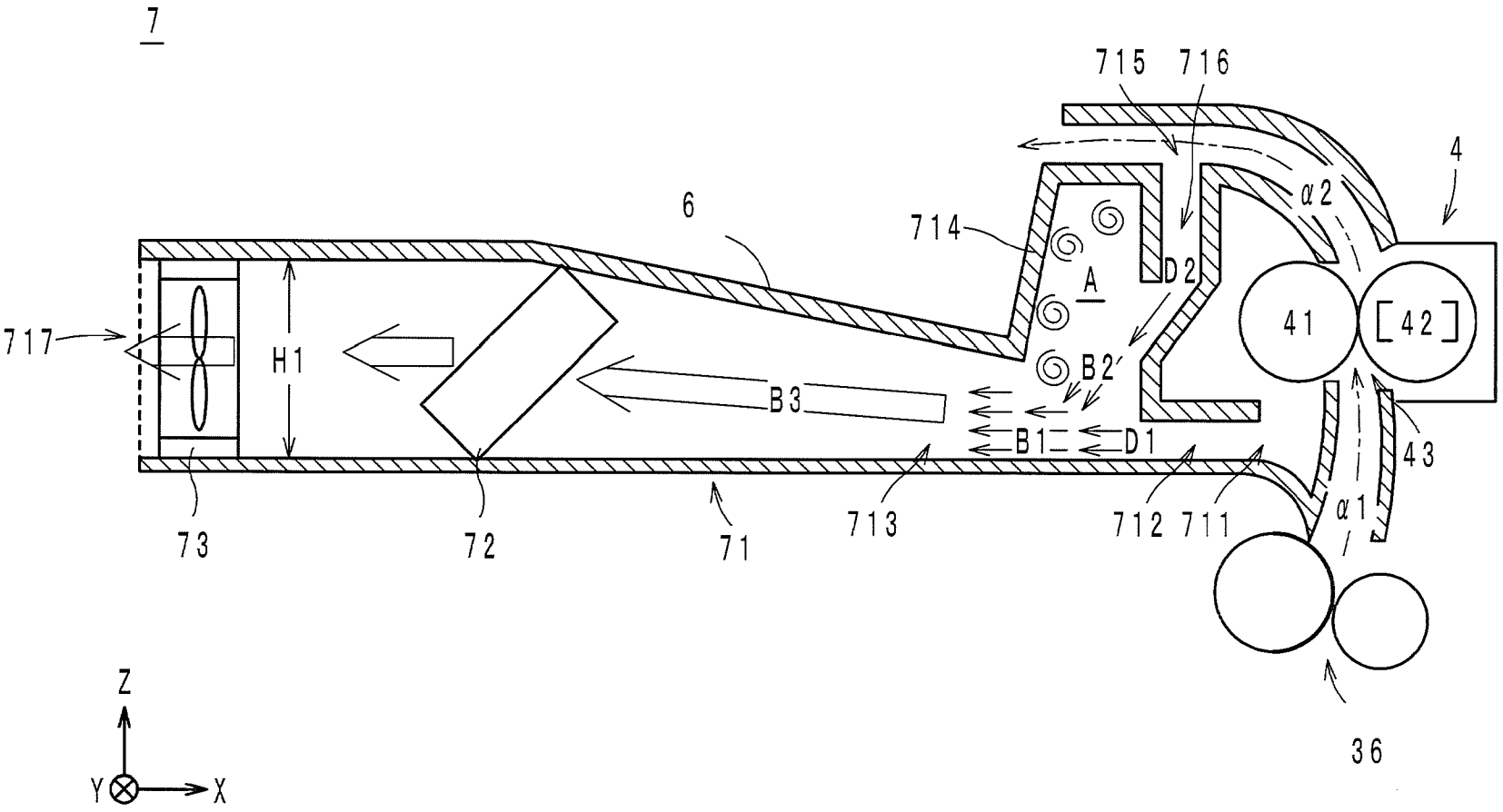
FIG. 3 is a diagram illustrating in detail the configuration of an exhaust system shown in FIG. 1.

FIG. 1 will be referenced again. The image forming apparatus 1 includes an exhaust system 7 for mainly trapping UFPs. The exhaust system 7 includes a duct 71, a filter 72, and a blowing unit 73, as shown in FIG. 3. The duct 71 is made of a metallic material, such as stainless steel, which, for example, is not surface-treated, and the duct 71 generally includes a first inlet 711, a first introduction channel 712, a main channel 713, a cul-de-sac 714, a second inlet 715, a second introduction channel 716, and an exhaust outlet 717.

An unfinished sheet is transported through a transportation path α1 located upstream from the fusing unit 4. The transportation path α1 extends upward from the secondary transfer area 36 to a point immediately in front of the entry of the nip 43 created by the rotors 41 and 42.

Figure 4:
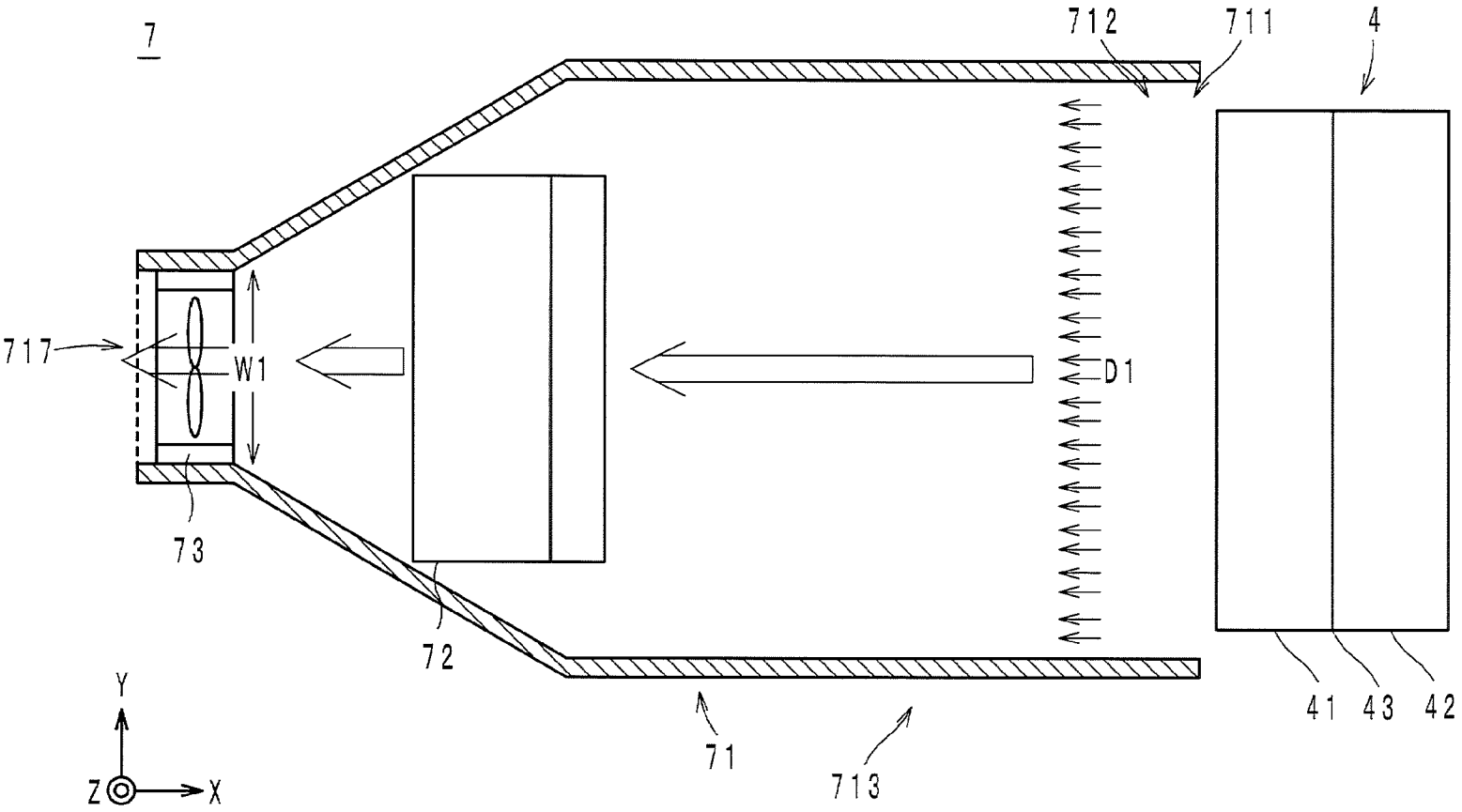
FIG. 4 is a horizontal cross-sectional view of a main channel shown in FIG. 3.

In the duct 71, when viewed in a front view, the inlet 711 is provided so as to face to the right in a position obliquely below and to the left of the rotors 41 and 42 and the nip 43. Further, the inlet 711 is positioned so as to face at least both ends of the rotor 41, which extends in the front-back direction, as shown in FIG. 4. In the present embodiment, the inlet 711 is an opening in the form of a slit that stretches over a length from one end of the rotor 41 to the other end. From the inlet 711 provided in such a position, air containing UFPs derived from the fusing unit 4 flows into the duct 71 when the blowing unit 73 to be described later is driven.

The introduction channel 712 extends from the inlet 711 leftward. Air flowing through the inlet 711 is guided leftward in the introduction channel 712. The guided air is jetted out from the left end of the introduction channel 712 into the main channel 713. The direction of air jetted out of the introduction channel 712 (i.e., a jet flow) will be referred to below as a first jetflow direction D1.

Furthermore, in the present embodiment, the introduction channel 712 has an approximately constant cross-sectional area S1 (e.g., 1822 $mm^2$) across its dimension from the right end to the left end. Moreover, the average velocity V1 of an air flow in the introduction channel 712 is 1.42 meters per second [m/s].

The introduction channel 712 communicates with the main channel 713 at the left end. The main channel 713 extends in the right-left direction from the left end of the introduction channel 712 to the left-side surface of the image forming apparatus 1. The main channel 713, when viewed in a front view, gradually increases in its height from the right end to a point from which an approximately constant height H1 is kept toward the left end. Here, the height H1 is designed in accordance with a dimension of the blowing unit 73 in the top-bottom direction.

FIG. 4 will now be referenced. FIG. 4 is a horizontal cross-section of the main channel 713 taken parallel to the XY plane and viewed from the positive side of the Z-axis. The main channel 713 is designed so as to be approximately constant in width from the right end to a point from which the width gradually decreases toward the left end. Moreover, the width W1 of the main channel 713 at the left end is designed in accordance with a dimension of the blowing unit 73 in the front-back direction.

FIG. 3 will be referenced again. The main channel 713 as described above receives air jetted out of the introduction channel 712. Moreover, the main channel 713 also receives air jetted out of the introduction channel 716 to be described later. The received air is guided leftward through the main channel 713.

Furthermore, in the present embodiment, the main channel 713 has a cross-sectional area S2 (e.g., 15,951 $mm^2$) on the immediately upstream side relative to the filter 72. Here, this cross-section is parallel to the YZ plane. Moreover, the average velocity V2 of an air flow in the cross-section is 0.23 m/s.

The cul-de-sac 714 is positioned above the right end of the main channel 713 (i.e., above the upstream end). The cul-de-sac 714 is open at one end so as to communicate with the main channel 713. The cul-de-sac 714 extends from that end in a direction approximately vertical to the jetflow direction D1. Moreover, the cul-de-sac 714 is closed at the other end (i.e., the top end). The cul-de-sac 714 has walls both in the front-back direction and in the right-left direction. The space surrounded by the top end of the cul-de-sac 714 and the walls in the front-back direction and the right-left direction will be referred to below as a cul-de-sac space A.

Here, to enhance the capability of trapping UFPs, it is preferable that the cul-de-sac 714 be open at the bottom end and closed at the top end in a manner as described above.

Incidentally, the sheet S subjected to the fixing process is fed into a transportation path α2, which is located on the downstream side relative to the fusing unit 4. The transportation path α2 extends upward from the exit of the nip 43 to the left.

In the duct 71, when viewed in a front view, the inlet 715 is provided in the bottom surface of the transportation path α2 so as to face upward. From the viewpoint of suppressing the amount of UFPs released, the inlet 715 is preferably positioned in the transportation path α2 close to the exit of the nip 43, rather than distant therefrom toward the tray 6. Moreover, the inlet 715, when viewed in a top view, is positioned so as to face at least both ends of the rotor 41 extending in the front-back direction. The inlet 715 is an opening in the form of a slit having approximately the same dimension in the Y-axis direction as the inlet 711. The inlet 715 provided in such a position receives air containing UFPs derived from the fusing unit 4, when the blowing unit 73 is driven.

The introduction channel 716 extends from the inlet 715 downward. The air having entered the inlet 715 is guided through the introduction channel 716 downward. The guided air is jetted out of the bottom end of the introduction channel 716 toward the opening at the bottom end of the cul-de-sac 714. The bottom end of the introduction channel 716, i.e., an air vent, is positioned at the right wall of the cul-de-sac 714 near the bottom side. The direction of the air jetted out of the introduction channel 716 (i.e., jet flow) will be referred to below as a second jetflow direction D2.

Here, in the present embodiment, the introduction channel 716 has an approximately constant cross-sectional area S3 (e.g., 592 $mm^2$) across its dimension from the top end to the bottom end. Moreover, the average velocity V3 of an air flow in the introduction channel 716 is 1.68 m/s.

Further, the filter 72 is positioned on the upstream side relative to the blowing unit 73 in the main channel 713. The filter 72 mainly traps UFPs from the air being guided through the main channel 713.

Still further, the blowing unit 73 is typically a fan having a diameter of from 50 mm to 100 mm and positioned near the left end of the main channel 713 (i.e., immediately before the exhaust outlet 717). The blowing unit 73 is rotated by a drive force from an unillustrated motor, thereby discharging air inside the main channel 713 to the outside of the image forming apparatus 1 through the exhaust outlet 717.

Air Flow in Exhaust System

In the exhaust system 7, to trap UFPs derived from the fusing unit 4, the blowing unit 73 is driven during a fixing process, so that air in the duct 71 flows toward the exhaust outlet 715. As a result, the air, which contains UFPs, is taken in from the first inlet 711, and guided through the first introduction channel 712 to be jetted out into the main channel 713. Moreover, air which contains UFPs is taken in also from the second inlet 715, and guided through the second introduction channel 716 to be jetted out toward one end of the cul-de-sac space A (i.e., near the connection of the main channel 713 and the cul-de-sac 714). The air jetted out of the introduction channels 712 and 716 flows into the main channel 713 and passes through the filter 72 and the blowing unit 73 to be discharged from the exhaust outlet 717 to the outside of the image forming apparatus 1.

Actions and Main Effects of Exhaust System

In the exhaust system 7 thus configured, air jetted out of the introduction channel 712 (i.e., a jet flow) passes below the cul-de-sac space A, as indicated by arrow B1 in FIG. 3, to be guided to the downstream side in the main channel 713. The air jet from the introduction channel 716 flows below the bottom of the cul-de-sac space A, as indicated by arrow B2 in FIG. 3, to be caused to merge with the air flowing in the main channel 713 and directed toward the downstream side.

Such an air flow entrains air existing in the cul-de-sac space A by virtue of the Coanda effect. As a result, relatively high negative pressure occurs around the air flow in the cul-de-sac space A. The negative pressure causes turbulence in the cul-de-sac space A. In FIG. 3, the turbulence is indicated by vortexes. In general, UFPs around the walls of the cul-de-sac 714 are caused to adhere to the walls by virtue of, for example, electrostatic force, liquid bridge force, and Van del Waars force. Here, the process in which particles contained in a gas adhere to surrounding walls is described in, for example, "Deposition of Aerosol Particles on Solid Surfaces", Manabu Shimada and one other, Earozoru Kenkyu (Journal of Aerosol Research), Vol. 3, No. 4 (1988). In the exhaust system 7, the adhesion of UFPs to the walls of the cul-de-sac 714 is further promoted by turbulent diffusion due to the turbulence caused in the cul-de-sac space A, in addition to the aforementioned forces, including electrostatic force. In this manner, the exhaust system 7 allows the cul-de-sac 714 to trap UFPs, so that the number of UFPs to be transported to the filter 72 provided on the downstream side can be reduced, and further, the amount of UFP emission to the outside of the image forming apparatus 1 can be reduced. Note that the UFPs that flow toward the filter 72 on the downstream side adhere in part to the inner wall of the main channel 713 to be trapped thereon.

To quantify the effect of the exhaust system 7, the present inventors compared the image forming apparatus 1 including the exhaust system 7 (see FIG. 1) with an image forming apparatus 9 including an exhaust system 8 according to a comparative example (see FIG. 5) in terms of the amount of UFP emission. The exhaust system 8 according to the comparative example will be described first.

Figure 5:
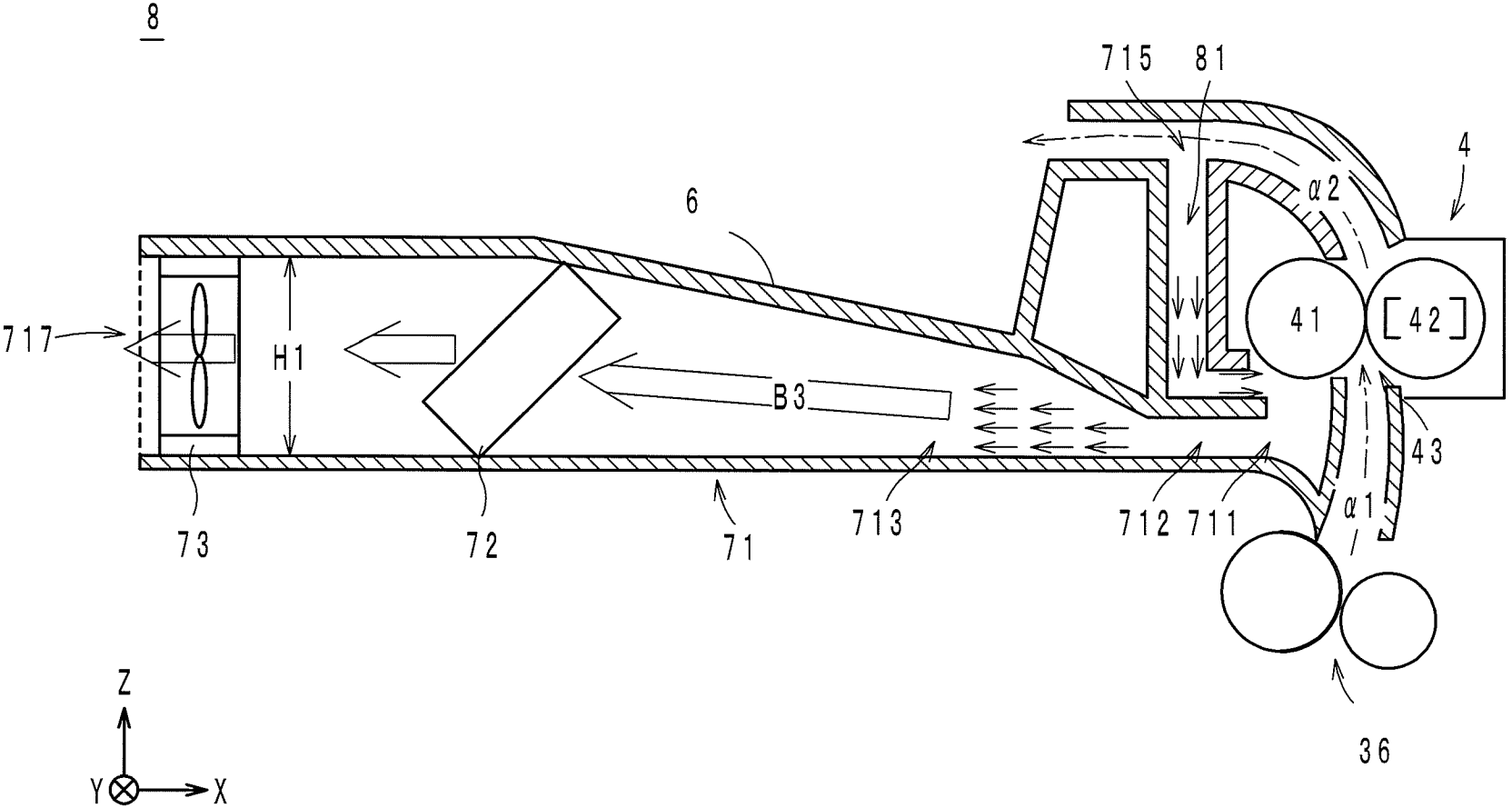
FIG. 5 is a diagram illustrating the configuration of an exhaust system according to a comparative example.

In FIG. 5, the exhaust system 8 is different from the exhaust system 7 in that the cul-de-sac 714 is not provided, and an introduction path 81 is provided in place of the introduction channel 716. There are no other differences between the exhaust systems 7 and 8. Accordingly, in FIG. 5, any elements corresponding to those shown in FIG. 3 are denoted by the same reference numerals, and any descriptions thereof will be omitted. Moreover, in the exhaust system 8 also, the main channel 713 has a cross-sectional area S2 (e.g., 15,951 $mm^2$) on the immediately upstream side relative to the filter 72, and the average velocity V2 of an air flow in the cross-section is 0.23 m/s.

The introduction path 81 extends from the inlet 715 downward, and is bent rightward (i.e., toward the fusing unit 4) at the bottom so as to form an approximately right angle.

Accordingly, the introduction path 81 ends below the first rotor 41, and is open at the end. This opening communicates with the inlet 711 of the introduction channel 712. Therefore, air having entered the introduction path 81 through the inlet 715 is guided first downward and then rightward to be jetted out of the opening of the introduction path 81. The air jet is guided through the introduction channel 712 after merging with the air having entered through the inlet 711.

The present inventors measured the number of UFPs discharged from each of the image forming apparatuses 1 and 9. The UFPs were measured in accordance with a test method which met the requirements for acquisition of the Blue Angel Mark (BAM). Details of the measurements are as will be described below.

Each of the image forming apparatuses 1 and 9 was placed in a measurement room. The temperature inside the measurement room was approximately from 22° C. to 23° C., and the humidity was about 50%.

In the measurement room, each of the image forming apparatuses 1 and 9 was kept on standby for 60 minutes after power-on, and then continued to print for 10 minutes. Specifically, color printing patterns for use in the BAM test were printed on one side of A4 sheets.

A fast mobility particle sizer (FMPS) 3091 from Tokyo Dylec Corp. was used to measure the amount of UFP emission. The measurement results for the amount of UFP emission were $1.0\times10^{11}$ counts per 10 minutes for the image forming apparatus 1, and $2.0\times10^{11}$ counts per 10 minutes for the image forming apparatus 9. In this manner, there was confirmed to be a difference of two times in the amount of UFP emission between the presence and the absence of the cul-de-sac 714.

Other Effects

Furthermore, it is preferable that the cul-de-sac 714 be connected with the main channel 713 on the bottom-end side and closed on the top-end side, as shown in FIG. 3. The reason for this is that, because air containing UFPs is at a high temperature and therefore is prone to rise, adhesion of UFPs to the top end of the cul-de-sac 714 is facilitated by closing the cul-de-sac 714 on the top-end side. Thus, the capability of trapping UFPs can be enhanced.

In addition, the cul-de-sac 714 is preferably provided at the upstream end of the main channel 713, as shown in FIG. 3. Accordingly, in the main channel 713, the average velocity of the air flowing below the cul-de-sac 714 (i.e., at the upstream end of the main channel 713), as indicated by arrows B1 and B2, is higher than that of the air flowing on the downstream side relative to the connection of the main channel 713 and the cul-de-sac 714, as indicated by arrow B3 in FIG. 3. As a result, relatively more negative pressure occurs around the air flow in the cul-de-sac space A, so that UFPs can be trapped in the cul-de-sac 714 more efficiently.

Further, the cul-de-sac 714 preferably crosses the main channel 713 approximately at a right angle. The crossing approximately at a right angle causes the air flowing out of the introduction channel 712 in the jetflow direction D1 to hit the downstream wall of the cul-de-sac 714 (in FIG. 3, on the left side), which facilitates the occurrence of turbulence. Moreover, since the introduction channel 716 is provided along the upstream wall of the cul-de-sac 714, the air flowing out of the introduction channel 716 in the second jetflow direction D2 is caused to hit the cul-de-sac 714 in the lower portion of its downstream wall more readily, which facilitates the occurrence of turbulence. In this manner, the occurrence of turbulence in the cul-de-sac space A is facilitated, leading to an enhanced capability of trapping UFPs.

Still further, a set of an inlet and an introduction channel is preferably provided on each of the upstream (i.e., bottom) and downstream (i.e., top) sides relative to the nip 43 and the first rotor 41 in the transportation path α for the sheet S, as shown in FIG. 3. As a result, more UFPs can be trapped, resulting in a further reduction in the amount of UFP emission.

Yet further, air is jetted out from the second introduction channel 716 preferably toward one end of the cul-de-sac 714, as shown in FIG. 3. More specifically, the air jet from the second introduction channel 716 basically travels through the opening of the cul-de-sac 714 to be caused to merge with an air jet from the first introduction channel 712 toward the main channel 713. The merger facilitates the occurrence of turbulence at that end of the cul-de-sac 714. Thus, UFPs can adhere to the wall of the cul-de-sac 714 more readily.

Supplementary

Furthermore, the downstream wall of the cul-de-sac 714 is slanted, rather than perpendicular (vertical) to the bottom of the duct 71, such that the space defined by the wall increases toward the bottom, as shown in FIG. 3, but this shape is not limiting, and the cul-de-sac 714 may have a duct-like shape that extends vertically.

In addition, the distance between the bottom end of the downstream wall of the cul-de-sac 714 and the bottom surface of the duct 71 is greater than the dimension (height) of the introduction channel 712 in the top-bottom direction, but it can be equal to the height of the introduction channel 712.

Figure 6:
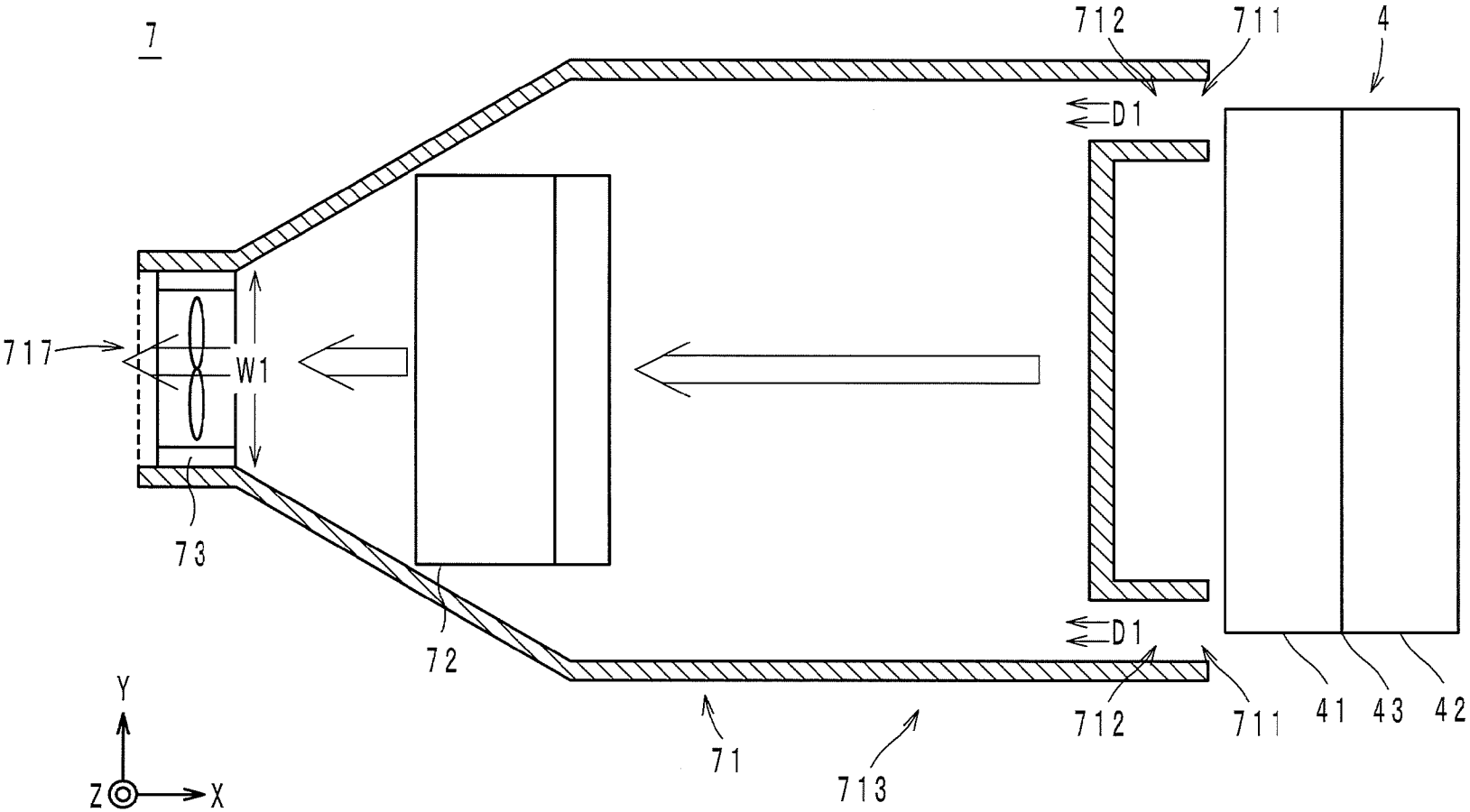
FIG. 6 is a horizontal cross-sectional view illustrating another configuration example of the main channel shown in FIG. 3.

Further, the inlet 711 has been described above as being a slit-like opening that runs from one end of the rotor 41 to the other end, as shown in FIG. 4. However, this is not limiting, and two slit-like openings may be provided as inlets 711, so as to face opposite ends, respectively, of the rotor 41 extending in the front-back direction, as shown in FIG. 6. As with the inlets 711, two slit-like openings may be provided as inlets 715.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

an image forming unit for feeding a sheet after forming a toner image on the sheet;

a fusing unit including a first rotor provided with a heat-generating unit and an elastic layer, as well as a second rotor provided in direct contact with the first rotor to create a nip, the fusing unit fixing a toner image on a sheet fed by the image forming unit and introduced into the nip;

a duct for allowing a first inlet and an exhaust outlet to communicate with each other, the first inlet provided on an upstream side in a sheet transportation path relative to the nip and the first rotor and being adapted to allow a current of air derived from the fusing unit to flow in, the exhaust outlet facing toward the outside of the apparatus; and a blowing unit comprising a fan, for causing a current of air toward the exhaust outlet within the duct, wherein, the duct includes:

a first introduction channel for guiding air taken in from the first inlet and jetting out air taken in from the first inlet;

a main channel for guiding the air jetted out of the first introduction channel to the exhaust outlet; and a cul-de-sac provided in communication with the main channel at one end and closed at the other end;

a second inlet provided on a downstream side in the sheet transportation path relative to the nip and the first rotor; and a second introduction channel for guiding air taken in from the second inlet and jetting out the air from between the one end and the other end of the cul-de-sac.

2. The image forming apparatus according to claim 1, wherein the one end and the other end of the cul-de-sac are a bottom end and a top end, respectively.

3. The image forming apparatus according to claim 1, wherein the cul-de-sac is provided at an upstream end of the main channel.

4. The image forming apparatus according to claim 1, wherein the cul-de-sac crosses the main channel approximately at a right angle.

5. The image forming apparatus according to claim 1, wherein the second introduction channel jets out air toward the one end of the cul-de-sac.

6. The image forming apparatus according to claim 1, wherein a filter is provided in the main channel, the one end of the cul-de-sac that is in communication with the main channel is an opening of the cul-de-sac, and the opening is provided upstream of the filter.

7. The image forming apparatus according to claim 1, wherein the one end of the cul-de-sac that is in communication with the main channel is an opening of the cul-de-sac, and the opening opens into the main channel at a right angle.

* * * * *